US006519775B1

(12) United States Patent
Garcia

(10) Patent No.: US 6,519,775 B1
(45) Date of Patent: Feb. 18, 2003

(54) THIGH PROTECTIVE DEVICE FOR CONSTRUCTION WORKERS AND METHOD OF USING SAME

(76) Inventor: Nicolas Garcia, 2107 W. Commonwealth Ave. #447, Alhambra, CA (US) 91803

( * ) Notice: Subject to any disclaimer, the term of this patent is extended or adjusted under 35 U.S.C. 154(b) by 0 days.

(21) Appl. No.: 09/074,899

(22) Filed: May 8, 1998

(51) Int. Cl.[7] ..... A41D 13/00
(52) U.S. Cl. ..... 2/22; 2/51
(58) Field of Search ..... 2/455, 466, 22, 2/23, 24, 51; 224/907, 663, 664, 665, 666

(56) References Cited

U.S. PATENT DOCUMENTS

| | | | | |
|---|---|---|---|---|
| 562,608 | A | 6/1896 | Herbelin | |
| 1,119,860 | A | * 12/1914 | Nelson | 2/51 |
| 1,373,377 | A | * 3/1921 | Albin | 2/465 |
| 1,720,439 | A | * 7/1929 | Richardson | 2/466 |
| 2,555,786 | A | 6/1951 | Dasinger | |
| D210,190 | S | 2/1968 | Garcia | |
| 3,533,106 | A | * 10/1970 | Kremp | 2/22 |
| D278,279 | S | 4/1985 | Vacanti | |
| D280,250 | S | 8/1985 | Vacanti | |
| 4,688,269 | A | * 8/1987 | Maeshima | 2/16 |
| 4,697,286 | A | * 10/1987 | Cho | 2/22 |
| 5,372,262 | A | * 12/1994 | Carter | 2/23 |
| 5,611,079 | A | 3/1997 | Bain, III | |
| 5,791,538 | A | * 8/1998 | Bain, III | 224/663 |

* cited by examiner

*Primary Examiner*—Rodney M. Lindsey
(74) *Attorney, Agent, or Firm*—Christie, Parker & Hale, LLP

(57) ABSTRACT

A thigh protector for rodman comprised of a shield member which extends over the thigh from the groin to approximately the knee and a reinforcing member positioned underneath the shield member at a location where the rodman will position one or more rods. The reinforcing member is preferably comprised of a narrow piece of curved material that serves the function of keeping the shield member centered on the front of the rodman's thigh and also distributes the weight of the one or more rebars that are positioned on the rodman's thigh so as to reduce the likelihood of the one or more rebars injuring the rodman's thigh. In use, the rodman carries the bundle of rebar on their shoulders and then positions a front leg forward with the knees slightly bent so that the thigh, which is wearing the thigh protector, is at least partially horizontal. The bundle of rods are then dropped onto the thigh and the rodman holds them in place with at least one of their hands. A single rod is then selected out of the bundle of rods and is dropped so as to slide down the shield member towards the rodman's knee from where it falls to the ground. The shield member protects the thigh and the rodman's clothing from damage that results from the rebar sliding along the shield member and the reinforcing member further protects the thigh from injury as a result of the thigh having to bear the weight of the bundle of rods.

12 Claims, 4 Drawing Sheets

THIGH PROTECTIVE DEVICE FOR CONSTRUCTION WORKERS AND METHOD OF USING SAME

FIELD OF THE INVENTION

The present invention relates to a protective device worn by construction workers and a method of using the same and, in particular, concerns thigh protectors to be worn by steel workers who are engaged in the task of moving elongate pieces of reinforcing material, such as steel rebar, and depositing these pieces of reinforcing material at various locations on the construction site.

DESCRIPTION OF THE RELATED ART

The construction of roads, bridges and buildings are tasks that are very labor intensive. While heavy construction equipment is used to move some structural components, a tremendous amount of the movement and positioning of structural components of the road, bridge or building are moved by hand. One such construction material that is used in almost all large structures is rebar rods. Rebar rods comprise long steel rods that can be between ½ to 4 inches in diameter that are positioned in concrete so as to provide reinforcement and additional strength to the structure. Typically, rebar is delivered to a central location on the job site by trucks. However, as the rebar is likely to have to be distributed at many different locations on the job site, individuals, often referred to as rodmen, pick up bundles of rebar and carry them to the location where individual rebar rods are to be installed.

Generally, several rodmen will pick up a bundle of rebar and carry it on their shoulders or suitcase-style at their waistside to the particular location where one or more pieces of rebar are to be installed. Each piece of rebar in a bundle has a diameter of between ½ to 4 inches and can be up to 40 or 50 feet long. Hence, each individual rebar rod can be quite heavy and moving a bundle of this rebar is a particularly difficult task. Moreover, it is also difficult to pull a single rebar rod out of the bundle of rebar rods and place it at a particular location on the job site.

Typically, the rodmen carry the bundle of rebar rods on their shoulder walking in a single file line to the particular location. When the rodmen get to the location that is to receive a single rebar rod, the rodmen place one foot forward and crouch at the knees so that their upper thigh is somewhat horizontal. The rodmen, in unison, lift the bundle of rods off of their shoulder onto their thigh. Subsequently, a single rod of rebar is shaken out of the bundle and released by the rodmen so that it slides off of the rodmen's thighs and lands on the ground. Typically, the rodmen, while still in the crouched position, move backward in unison and then drop another of the rods of rebar at the new location. This process is often repeated until all of the rebar is deposited in a particular area in the construction site. Alternatively, the rodmen can drop a limited number of rebar rods at a particular location and can then return the bundle to their shoulder and move to a new location.

One difficulty that is encountered by rodmen during this process is the rods are so heavy that, when the bundle of rebar is dropped onto the thighs, injuries can result. In fact, each of the rodmen may be dropping a bundle of rebar rods on to their thighs that will weigh several hundred pounds. This can result in bruising of the rodmen's thighs. Moreover, as the rebar can have razor sharp edges, the rodmen may also receive cuts and puncture wounds. Further, when the single rebar rod is shaken out of the bundle, the single rod generally slides along the rodman's thigh and then drops towards the ground after it slides over the rodman's knee. Again, each individual rod can be so heavy that this sliding motion can further result in injuries to the rodman. Moreover, the dropping of the bundle of rods onto the rodman's thighs and the sliding of a single rod off of the rodman's thighs generally results in extensive wear and tear to the rodman's clothing.

Hence, from the foregoing, there is a need for some sort of protective device that can be worn by a rodman that will provide greater protection for the rodman during the process of moving and carrying bundles of rebar. Protective devices for legs have been used in other applications in the past. For example, cowboys have often worn chaps which are leather coverings that extend essentially along the whole length of the leg. However, chaps were designed to protect the full length of the cowboy's legs and clothing from scrapes and cuts caused by bushes and the like when riding a horse through rough terrain. As chaps are designed to be worn while generally sitting, they are typically very encumbering when walking. Consequently, this type of protective clothing is not very suited for use by rodmen who must be generally unencumbered to perform their other job duties. Sporting manufacturers have developed protective pads that protect the thighs of athletes. For example, football players often wear pants that have pads inserted therein which are designed to reduce thigh injuries. However, these types of protective pads have generally not been adapted for use by construction workers and, in particular, rodmen.

Moreover, the long standing custom in the construction trades is that the construction worker will generally wear only a heavy-duty pair of trousers such as jeans. This longstanding custom is the result of the construction workers and, in particular, rodmen being required to do a significant number of tasks, other than carrying heavy bundles of rebar. These other tasks require that the rodman be generally unencumbered and able to easily move about tight spaces on the job site. Consequently, there has been little effort on the part of the construction industries to adapt protection for use by rodmen that will protect the rodmen from injuries resulting from moving large bundles of rebar but will still allow the rodmen to perform other tasks in an unencumbered fashion.

Hence, there is a continued need for some sort of thigh protector or a method of moving rebar that is specifically adapted for use by rodmen. This thigh protector or method of moving rebar should provide protection against injury and, yet, should not inhibit walking or movement of the rodmen during the performance of their other job duties. To this end, the protective device should be relatively lightweight, form fitting, and able to absorb and distribute the weight of a bundle of rebar when the bundle of rebar is deposited onto the rodman's thigh.

SUMMARY OF THE INVENTION

The aforementioned needs are satisfied by the thigh protector of the present invention which is comprised of a thigh protector made of a first material that is sized so as to cover the thigh of the rodman from the point where the thigh of the rodman meets the groin, downwards to approximately the knee. In one aspect of the invention, the thigh protector includes a narrow piece of reinforcing material that is mounted adjacent the first material at a location selected so that when the bundle of rods are deposited onto the thigh of the rodman the reinforcing material distributes the weight of the rods so as to reduce the likelihood of bruising through the first material.

In one embodiment, the first material is comprised of heavy duty leather and the thigh protector incorporates an attachment mechanism for attaching and securely mounting the thigh protector on the thigh of the rodman. In one embodiment, the attachment mechanism is comprised of a loop that is adapted to fit around the rodman's belt and elastic material coupled to buckles which buckle around the rodman's thigh so as to keep the thigh protector centered on the rodman's thigh. Preferably, the elastic strap is adapted so as to be positioned adjacent the interface between the back of the rodman's thigh and the butt so that the strap is located adjacent the interface between the inside of the rodman's thigh and the rodman's crotch. The positioning of the strap in this location results in the strap remaining stationary during walking movement of the rodman which results in a device that does not encumber or otherwise hinder the freedom of movement of the rodman.

In one embodiment, the reinforcing member is preferably curved so as to fit the contours of the rodman's thigh. The combination of the curvature of the reinforcing member, the belt loop and the elastic straps keeps the shield member centered on the front of the rodman's thigh during subsequent movement of the rodman.

In another aspect of the invention, a method of moving bundles of rebar is provided. The method of this aspect of the invention is comprised of a plurality of rodmen walking single file while carrying a bundle of rebar on their shoulder to a first location, then extending a leg forward and bending at the knees so that the upper thigh of a rodman is bent so as to have a component that is parallel to the ground wherein the upper thigh is encased in a thigh protector; dropping the bundle of rebar onto a first location on the thigh protector, wherein the first location of the thigh protector is immediately over a reinforcing material of the thigh protector so that the weight of the rebar is distributed by the reinforcing member; selecting one of the bundle of rebar and removing it from the bundle; and then releasing the selected rebar so that it slides along the thigh protector and drops to the ground.

From the foregoing, it will be appreciated that the thigh protector provides increased protection for steel workers and, in particular, rodmen, when carrying bundles of rebar on a job site so as to deposit individual pieces of the bundle of rebar at particular locations. It will also be appreciated that the thigh protector of the present invention is further adapted so as to generally not hinder the movement of the rodmen during the performance of their other duties. For example, the thigh protector is designed so as to be positioned over the thigh so as to not inhibit motion of any of the joints of the wearer. These and other objects and advantages of the present invention will become more fully apparent from the following description taken in conjunction with the accompanying drawings.

DETAILED DESCRIPTION OF THE PREFERRED EMBODIMENT

Figure 1:
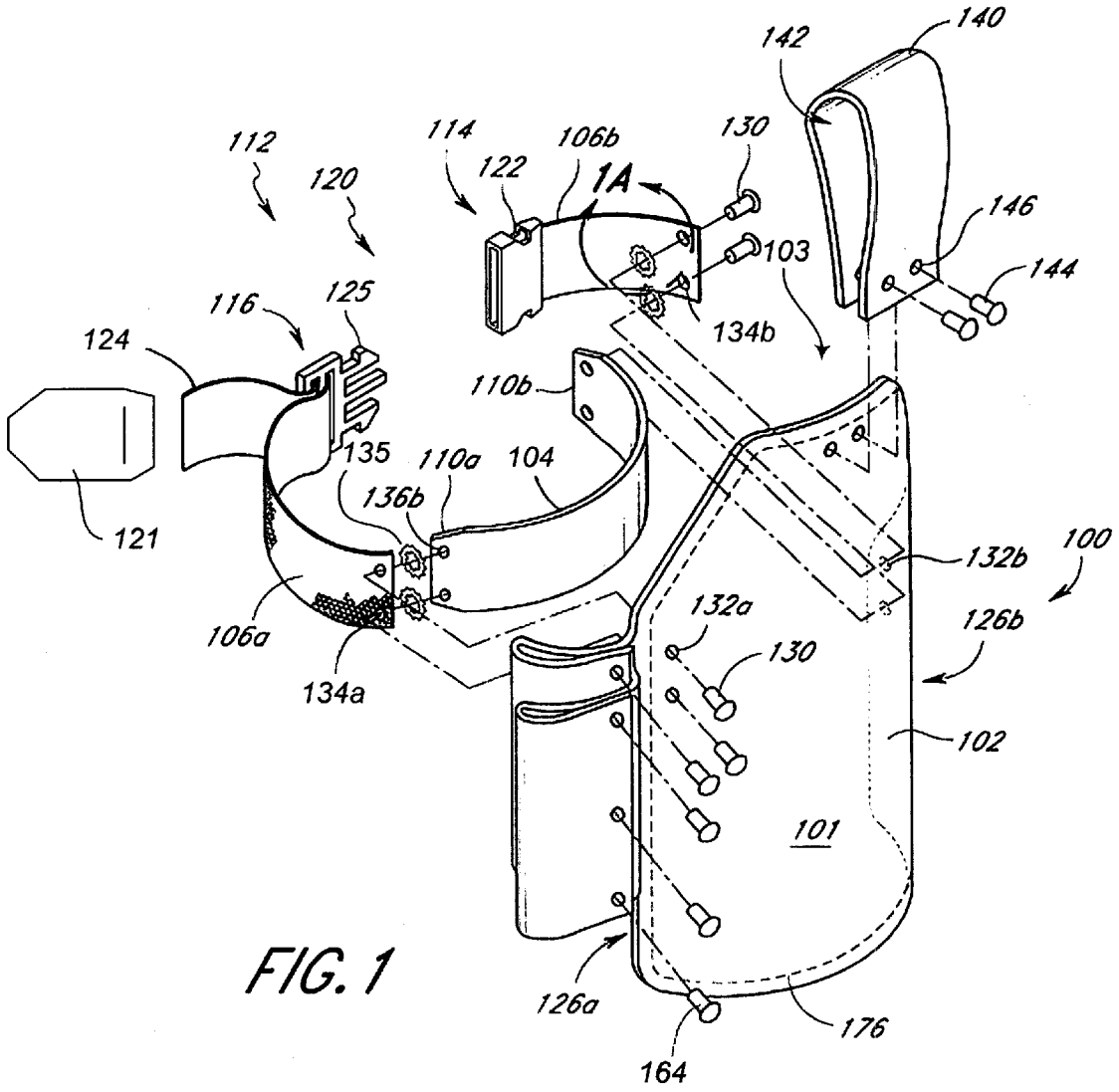
FIG. 1 is an exploded perspective view of a preferred embodiment of a thigh protector illustrating the components thereof.

Reference will now be made to the drawings where like numerals refer to like parts throughout. FIG. 1 is an exploded perspective view of a thigh protector 100 of the preferred embodiment. The thigh protector 100 includes a shield member 102 which is generally comprised of a planer piece of material such as leather. As it will be discussed in greater detail below, the shield protector 102 is sized and adapted so as to shield the portion of the user's leg from approximately the groin to the top of the knee, i.e., shielding the upper thigh of the user.

The thigh protector 100 also includes a piece of reinforcing material 104 which is positioned on a back side 103 of the shield member 102. The reinforcing member 104 is preferably formed out of a rigid material, such as plastic, so that when the user rests one or more rebars pieces on the front face 101 of the shield member 102, the weight is absorbed and distributed by the reinforcing member 104 so as to reduce the possibility of the user's thigh being bruised, pinched, cut or otherwise damaged by the weight or sharp ridges of the rebar. The length of the reinforcing member 104 is preferably sized so as to extend laterally across the backside 103 of the shield member 102.

A piece of elastic fabric 106*a* and 106*b* is attached to a first end 110*a* and a second end 110*b*, respectively, of the reinforcing member 104. A buckle mechanism 112 is attached to the elastic straps 106*a* and 106*b* so as to allow the user to buckle the thigh protector 100 around their thigh in a manner that will be described in greater detail below. The buckle mechanism 112 in the illustrated embodiment is comprised of a female buckle member 114 that is attached to the elastic strap 106*b* and a male buckle member 116 that is attached to the elastic strap 106*a*. The female buckle member 114 and the male buckle member 116 are preferably formed of plastic and the male buckle member 116 has a plurality of teeth 120 that are deformable so that the outer teeth 125 can be positioned within two openings 122 in the female buckle member 114 to securely retain the buckle members 114, 116 together in a manner that is known in the art. To dislodge the buckle members, the user simply depresses the teeth 125 that are protruding through the openings 122 in the female buckle member 114 and pull the buckle members 114 and 116 apart.

In this embodiment, the tension of the elastic members 106*a* and 106*b* can be adjusted by the user pulling on a tail end 124 of the elastic strap 106*a*. As will be described in greater detail below, it is preferable that the tail end 124 of the elastic strap 106*a* used for tightening be positioned on the outer side of the user's leg so that the user can easily grasp the tail end 124 and pull it outwards by reaching around the outer side of their leg. As is also illustrated in FIG. 1, a leather piece 121 may be attached to the tail end 124 of the elastic strap 106*a* to facilitate tightening of the straps 106.

The reinforcing member 104 and the elastic straps 106 are attached to the outer edges 126*a* and 126*b* of the shield member 102 via rivets 130 that extend through openings 132 in the shield member 102, openings 134 in the elastic straps and openings 136 in the reinforcing member 104. Moreover, as shown in FIG. 1, a washer 135 is also interposed between the inner surface 103 of the shield member 102 and the surface of the elastic straps 106*a* and 106*b*. The washer 135 is adapted to adhere to the fabric of the straps 106*a* and 106*b* and also to the fabric of the shield member 103 so as to reduce the likelihood that the rivets 130 will cause damage or deformation in the strap members 106. Preferably when the thigh protector 100 is assembled, the elastic strap 106 is interposed between the reinforcing member 104 and the backside 103 of the shield member 102.

Figure 2:
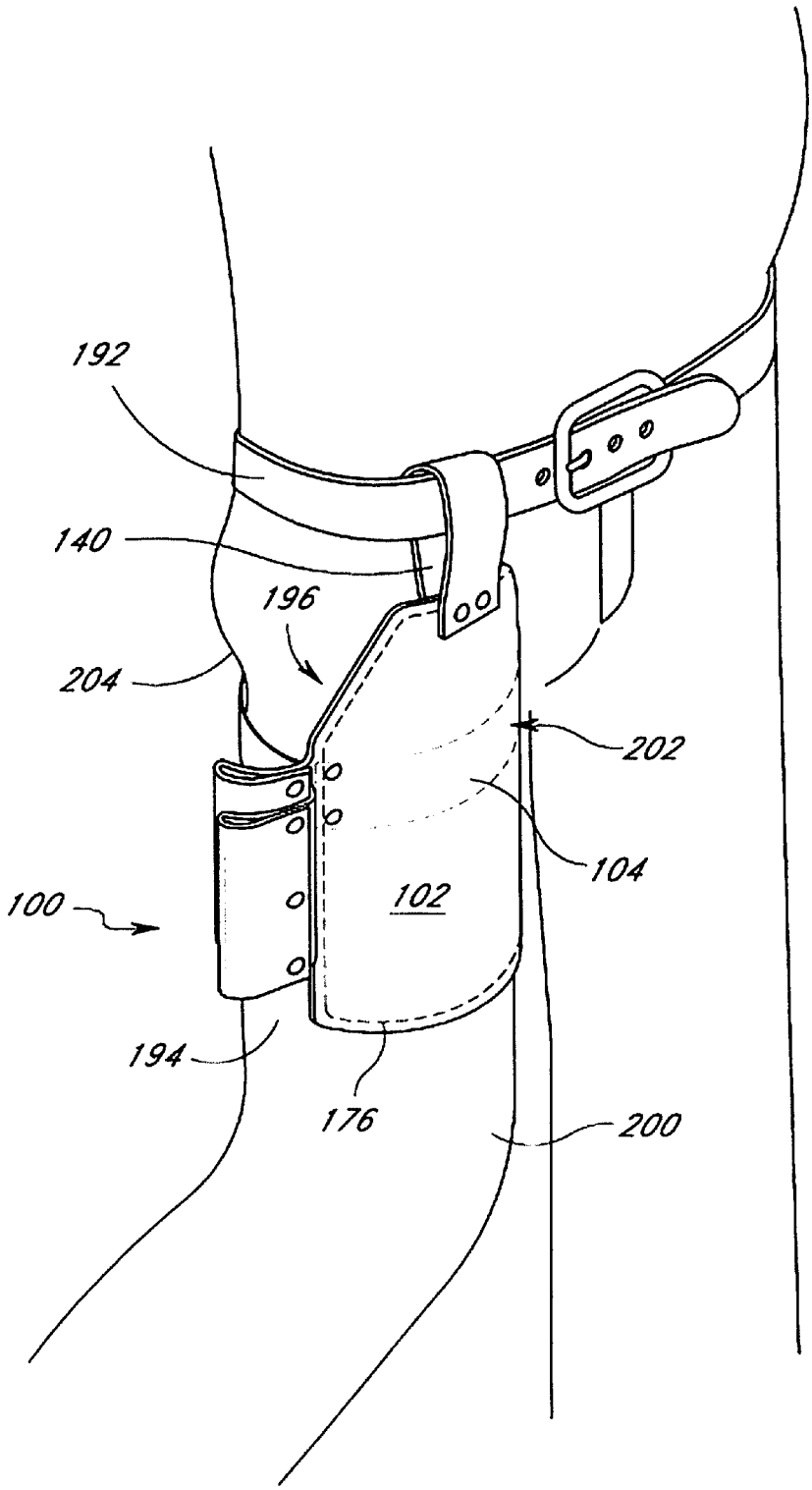
FIG. 2 is a perspective view of the thigh protector of FIG. 1 as it is positioned on the thigh of a rodman.

The thigh protector 100 of the illustrated embodiment also includes a belt loop member 140 that is comprised of a loop of flexible material defining an opening 142 that is sized so as to be positioned around the user's belt in a manner shown in FIG. 2. The belt loop member 140 is attached to the shield member 102 via rivets 144 that extend through openings 146 in the belt loop member 140 and openings 150 in the shield member 102.

The thigh protector 100 also includes a pocket member 160 that is preferably comprised of a single piece of stiff, yet flexible material, such as leather, that is folded over three times so as to define two openings 162. The material comprising the pocket member 160 is preferably held in position by three rivets 164 that extend through the four layers of material so as to retain the pocket member 160 in a shape that defines the openings 162. The openings 162 are preferably relatively narrow so as to allow sidecutters, chalk, sticks and other articles to be positioned within the openings 162 and retain therein by frictional engagement with the inner walls of the openings 162. The pocket member 160 is also preferably integrally attached to the shield member 102 so that a single piece of leather can be used to form these two portions of the thigh protector.

In the preferred embodiment, the shield member 102 is formed using a piece of leather that is generally 14½ inches long by 10 inches wide wherein the leather has a thickness in the range of five to nine ounces and more preferably, an average thickness of five to five and one half ounces. As shown in FIG. 1, the shield member 102 is preferably tapered towards the upper end so as to not bind on the user's crotch while the user is walking. As also shown in FIG. 1, there is a line of ornamental stitching 176 that is based approximately ¼-inch from the outer edge of the shield member 102.

The reinforcing member 104 is a curved piece of plastic that is approximately 2½ inches wide by 10¼ inches long that is curved so that the first and second edges 110*a* and 11*b* are approximately 6½ inches apart. In the preferred embodiment, the reinforcing member 104 is rounded off to be approximately 2 inches wide at the point of attachment of the elastic member 106*a* and 106*b*. Preferably, the reinforcing member 104 is located a first distance from the top of the belt member 140 wherein the first distance is selected so that, for the average user, the reinforcing member 104 is positioned adjacent the interface between the user's thigh and groin. This location is the preferred location to place the bundle of rebar as it places less stress on the joint and is therefore the preferred location for the reinforcing member 104. In this embodiment, the top of the reinforcing member 104 is attached to the back side 103 of the shield member 102 so as to be approximately 8 inches from the top of the belt member 140. The belt member 140 in this embodiment is sized so as to define an opening 142 for the belt that is approximately 3 inches wide.

The curved shape of the reinforcing member 104 is adapted to center the shield member 102 in the center of the user's thigh. The 6½ inch separation between the first and second ends 110*a* and 110*b* is selected so as to keep the shield member 102 centered about the average user's thigh. In the preferred embodiment, the reinforcing member 104 is made of a ballistic quality polycarbonate material that is approximately 1/16 inch in thickness. The reinforcing member 104 is preferably made of a generally rigid material so as to reduce pressure and bruising on the thigh and pinching of the underlying skin as will be described in greater detail below.

The elastic comprising the elastic straps 106*a* and 106*b* is preferably 2-inch wide heavy duty elastic such as the type of elastic that is used on horse saddles and the like. Consequently, it is a generally dense, relatively stiff, elastic material such as 8–10 ounce density elastic strap. The strap 106*a* that attaches to the female member 114 is preferably 12 inches in length and the strap that attaches to the male member 116 is preferably 7 inches in length. The increased length of the strap 106*b* attached to the male buckle member 120 allows for easy tightening of the buckle mechanism 112 by simply pulling the tail end of the strap 124 outward.

The rivets 130 used to attached the shield member 102 to the reinforcing member 104 and the elastic straps 106*a*, 106*b* in the illustrated embodiment preferably comprise ½-inch D head-type rivets having a ¼-inch diameter shaft that is ⅜ inch in length. The rivets 164 sewing the pocket member 160 are 3/16" D head-type rivets that are star clinched. The rivets 144 that attach the belt member 140 to the shield member 102 are preferably comprised of ½ inch D head-type rivets with a ¼-inch tube that is also approximately 7/16 inch in length that are preferably crush clinched.

Figure 1A:
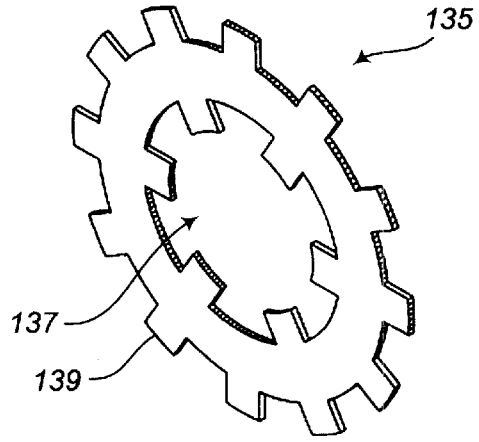
FIG. 1A is a perspective view of a double sided washer used in the thigh protector of FIG. 1.

FIG. 1A illustrates the washer 135 that is interposed between the straps 106*a*, 106*b* and the inside surface 103 of the shield member 102 in greater detail. As shown, the washer 135 includes an opening 136 that is adapted to receive the rivets 130. Further, the washer 135 also includes tabs 139 that alternately extend inward and outward away from the plane of the rivet 135. The tabs 139 are adapted to grasp onto the material on the inner surface 103 of the shield and also onto the surface of the material forming the straps 106*a* and 106*b* so as to strain relief the openings 134*a* and 134*b* in the straps. The washers 135 are similar to washers that are sold under a milspec (MS) standard.

Referring now to FIG. 2, the manner in which the thigh protector 100 is worn by a user 190 will be described in greater detail. In particular, the user initially runs a belt 192 through the opening 142 of the belt loop member 140. Subsequently, the user then buckles the buckle assembly 112 together and then pulls on the tail end 124 of the strap so as to have the reinforcing member 104 be positioned snugly against the outer surface of the user's thigh 194. As shown on FIG. 2, the shield member 102 preferably extends from a point adjacent the user's groin area 196 to a point just above the knee 200 of the user so that the shield member 102 does not cover any joint of the rodman that would otherwise hinder movement of the rodman. Further, the reinforcing member 104 and the elastic straps 106*a* and 106*b* are attached to the shield member 102 at a location where the straps are positioned immediately adjacent the user's crotch 202 and so that the straps 106*a* and 106*b* are positioned immediately underneath the user's buttocks 204 when buckled around the rodman's thigh. This placement of the straps

106*a* and 106*b* results in the straps being unlikely to move as a result of the user walking around while wearing the thigh protector 100.

Hence, the thigh protector 100 can be positioned so as to protect the user's thigh against damage that can result from carrying and positioning pieces of reinforcing material such as rebar while still permitting generally unencumbered movement by the user while wearing the thigh protector 100. It will be appreciated that while only a single thigh protector 100 is shown in FIG. 2, a rodman will preferably wear the thigh protectors 100 on each of their thighs while carrying and maneuvering the reinforcing material.

Figure 4:
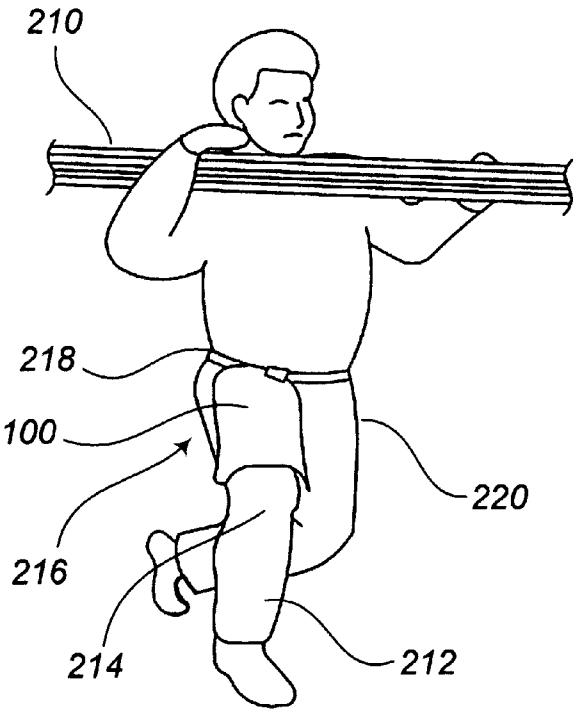
FIG. 4 is a schematic view illustrating the posture of a rodman as the rodman prepares to lower the bundle of rebar from his shoulder onto his thigh that is wearing the thigh protector of FIG. 1.
Figure 3:
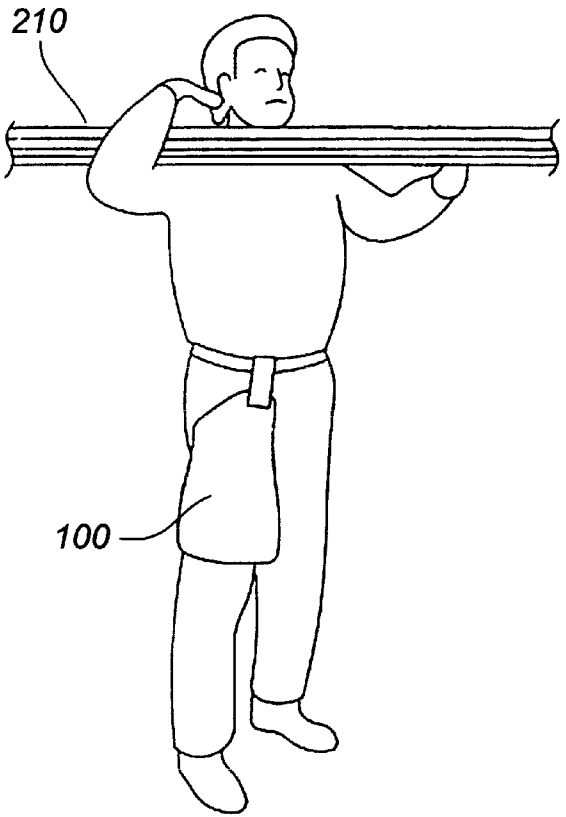
FIG. 3 is a schematic illustration illustrating how a rodman carries a bundle of rebar on his shoulder while wearing the thigh protector of FIG. 1.

The use of the thigh protectors 100 of the preferred embodiment will now be described in conjunction with the drawings of FIGS. 3 through 6. In particular, the thigh protector 100 is designed to be used by a construction worker, generally referred as a rodman, who is engaged in the task of moving pieces of rebar from one location to another. As is understood, generally a plurality of rodmen will grasp a stack or bundle of rebar 210 and carry it on their shoulders in the manner shown in FIG. 3. Alternatively, the rodmen may carry the bundle of rebar 210 under their arms in a suitcase style of carrying the rebar. The rodmen walk in single file to the location on the job site that is to receive one or more of the rebar rods. At this point, each of the rodmen assume a posture similar to the posture of the rodman shown in FIG. 4. Specifically, the rodman places a leg 212 forward with the knee 214 slightly bent so the thigh 216 of the rodman has a slight horizontal component, as shown in FIG. 4. The thigh 216 is preferably covered by the thigh protector 100 of the preferred embodiment. The opposite leg 220 is preferably positioned slightly behind the back of the rodman so as to provide stability when the rodman is lowering the bundle of rebar 210 onto the thigh 216 that is covered by the thigh protector 100 in the manner shown in FIG. 5.

More specifically, the bundle of rebar 210 is preferably lowered onto the thigh protector 100 at a point where the center of mass of the rods 210 is positioned on the shield member 102 at a location that is directly over the reinforcing member 104. In this manner, the reinforcing member 104 bears and distributes a significant portion of the weight of the rebar thereby reducing the likelihood of bruising, pinching or injury to the thigh 214 of the rodman as a result of the thighs bearing the weight of the bundle of rods. As discussed above, the thigh protector 100 is sized so that the reinforcing member 104 is generally positioned substantially adjacent the interface between the rodman's thigh 216 and groin 218. Positioning the bulk of the rods at this point allows for the greatest stability in handling and in carrying the rods 210.

Figure 6:
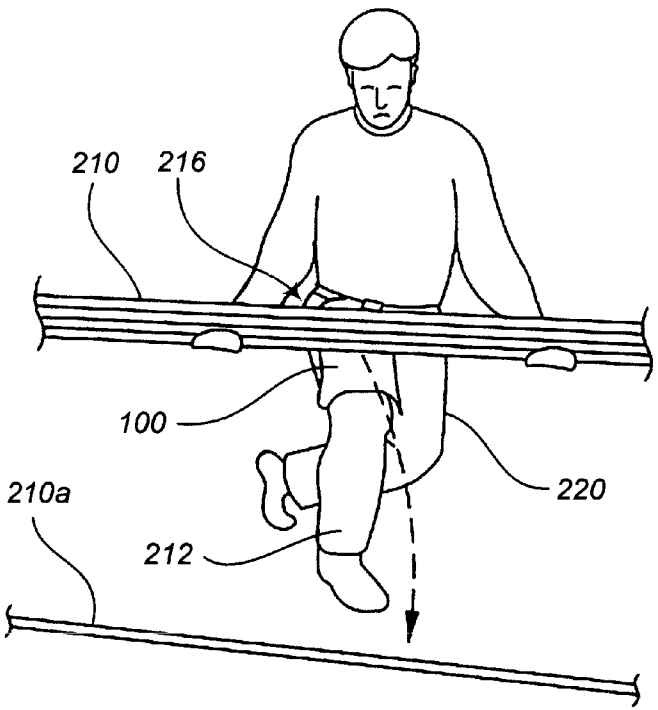
FIG. 6 is a schematic illustration illustrating how the rodman removes a single rod from the bundle of rods and deposits it to the ground.
Figure 5:
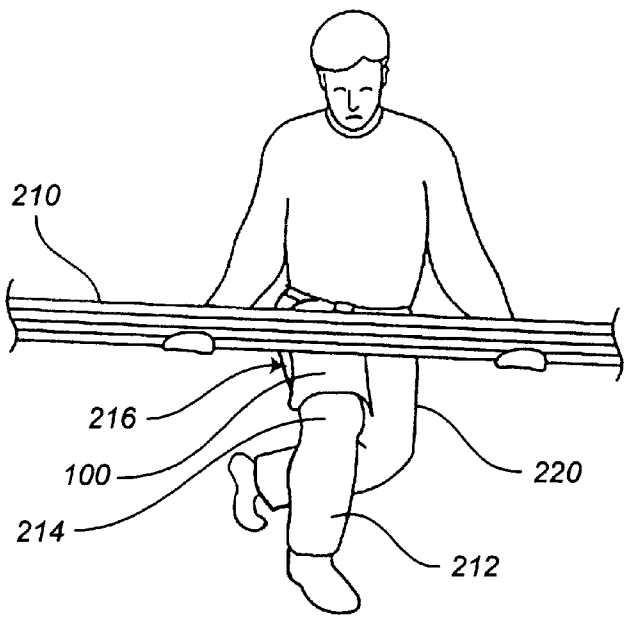
FIG. 5 is a schematic view illustrating the posture of the rodman as the rodman lowers the bundle of rods onto his thigh that is wearing the thigh protector of FIG. 1.

Once the rodmen have balanced the bundle of rebar 210 on their thighs 216 in the manner shown on FIG. 5, each of the rodmen select, in unison, a single rod 210*a* to shake loose out of the bundle of rods 210 and let fall to the ground in the manner shown in FIG. 6. Typically, the selected rod 210*a* is the rod that is located on the outermost portion of the bundle, i.e. the rod 210*a* located closest to the rodman's knee 214. It will, however, be appreciated that the rod that is adjacent one rodman's knee may not be the same rod for each rodman and that it is often necessary for the rodmen to balance the bundle of rods 210 on their thighs while fishing out a single rod for all of the rodmen to drop in unison in the manner shown by the single rodman of FIG. 6. The selected rod 210*a* then slides along the shield member 102 until it reaches a point adjacent the rodman's knee 214 where it falls onto the ground generally forward of the rodman's foot. Hence, the shield member 102 protects the rodman from injury and also protects the underlying cloth of the rodman from damage as a result of the rebar 210*a* sliding off of the rodman's thigh 216 onto the ground. Further, the rodmen may resume the posture shown in FIG. 4 and walk, in unison, backwards several feet to deposit another rebar 210*a* in the same manner as described above so that the pieces of rebar can be positioned adjacent each other in a generally parallel fashion to facilitate installation. Once the rebar has been deposited, the rodmen can return the remaining rebar to either their shoulder or under their arms to transport the remaining rebar single file to another location on the jobsite. The rodmen then pick the bundle off their thighs 216 in unison and return it to their shoulder so as to be able to transport the bundle of rods to the next location to deposit additional rods.

From the foregoing, it will be appreciated that the thigh protector 100 of the preferred embodiment enables the rodman to carry bundles of rebar to particular locations and then drop individual rods of rebar onto the ground in a manner where the likelihood injury to the rodman's thigh or damage to their clothing is reduced. In this embodiment, the combination of the shield member 102 extending generally over the length of the rodman's thigh and the reinforcing member 104 being positioned at a location where the rodmen are to rest the bundle of rebar reduces the likelihood of injury to the rodman's thigh or damage to the rodman's clothing.

Moreover, the configuration and attachment of the thigh protector 100 of the preferred embodiment to the rodman's belt and then also using a flexible elastic material to circle the rodman's thigh at a location immediately adjacent the groin securely maintains the thigh protector 100 on the rodman's thigh in a manner that does not encumber walking, bending or other movement of the rodman during other tasks that they would perform on the job site. Hence, the protector 100 of the preferred embodiment enables the rodman to comfortably move about the job site and still be able to transport rebar and deposit rebar at specific locations on the job site with the reduced risk of injury to themselves or to their clothing.

Although the foregoing invention has been described in terms of certain embodiments, other embodiments will become apparent to those of ordinary skill in the art, in view of the disclosure herein. Accordingly the present invention is not intended to be limited by the recitation of the preferred embodiments, but is instead intended to be defined solely by reference to the appended claims.

What is claimed is:

1. A thigh protector apparatus for use by a rodman wearing a belt when transporting reinforcing rods on a job site, the apparatus comprising:

a shield member sized so as to cover the thigh of a user, the shield member comprising a planar piece of flexible material that is adapted to reduce injury to the user's clothes as a result of positioning a bundle of reinforcing bars on the user's thigh and sliding a selected one of the bundle of reinforcing bars along at least a portion of the shield member so as to fall to the ground;

a reinforcing member attached to the shield member at a first location selected so as be adjacent the interface between the thigh and the groin of the user, wherein the reinforcing member comprises a curved rigid member that is attached to a side of the shield member that is positioned adjacent the thigh of the user so that the weight of the bundle of rods, when balanced on the user's thigh, is distributed by the reinforcing member so as to reduce the likelihood of injury occurring as a result of balancing the bundle of reinforcing rods on the user's thigh; and an attachment mechanism coupled with the shield member so as to retain the shield member in the desired location on the user's thigh wherein the attachment mechanism comprises a belt loop member attached to the shield member wherein the belt loop member defines an opening that is adapted to receive the belt of the rodman and buckle assembly that is attached to the shield member and is adapted to extend around the thigh of the rodman so as to encircle the rodman's thigh and retain the thigh protector on the front of the rodman's thigh.

2. The apparatus of claim 1, wherein the shield member is formed from a piece of leather.

3. The apparatus of claim 2, wherein the shield member is formed from a piece of leather having an average thickness of 5 to 5½ ounces.

4. The apparatus of claim 1, wherein the reinforcing member is comprised of a curved piece of plastic that is attached to a side of the shield member that is positioned adjacent the thigh of the user.

5. The apparatus of claim 4, wherein the reinforcing member is curved so as to match the contour of an average rodman's thigh so that the reinforcing member urges the shield member to stay in a first orientation with respect to the user's thigh.

6. The apparatus of claim 5, wherein the reinforcing member is comprised of a curved piece of polycarbonate plastic that is approximately 2 inches wide, 10¼" inches long and is curved so that the ends of the reinforcing member are approximately 6½ inches apart.

7. The apparatus of claim 1, wherein the reinforcing member is positioned a first distance from the belt loop member, the first distance being selected so that the reinforcing member will be positioned adjacent the interface between an average rodman's thigh and the average rodman's groin.

8. The apparatus of claim 1, wherein the buckle assembly includes two pieces of elastic material each of which are attached to opposite sides of the shield member and a male and female buckle member attached to the pieces of elastic material.

9. The apparatus of claim 8, wherein the two pieces of elastic material are attached to the opposite sides of the shield member at positions where the elastic member is positioned adjacent the interface between the butt and the back of the thigh of an average rodman.

10. The apparatus of claim 9, wherein a washer is interposed between the elastic material and the shield member and wherein the washer is adapted to grasp the material forming the shield member and the elastic material so as to provide strain relief to the elastic material.

11. A thigh protector apparatus for use by a rodman wearing a belt when transporting reinforcing rods on a job site, the apparatus comprising:

a shield member sized so as to cover the thigh of a user, the shield member comprising a planar piece of flexible material that is adapted to reduce injury to the user's clothes as a result of positioning a bundle of reinforcing bars on the user's thigh and sliding a selected one of the bundle of reinforcing bars along at least a portion of the shield member so as to fall to the ground;

a reinforcing member attached to the shield member at a first location selected so as be adjacent the interface between the thigh and the groin of the user such that the reinforcing member is positioned immediately adjacent the thigh of the user, wherein the reinforcing member comprises a curved rigid member that is attached to a side of the shield member that is positioned adjacent the thigh of the user so that the weight of the bundle of rods, when balanced on the user's thigh, is distributed by the reinforcing member so as to reduce the likelihood of injury occurring as a result of balancing the bundle of reinforcing rods on the user's thigh; and an attachment mechanism coupled with the shield member so as to retain the shield member in the desired location on the user's thigh.

12. A thigh protector apparatus for use by a rodman wearing a belt when transporting reinforcing rods on a job site, the apparatus comprising:

a shield member sized so as to cover the thigh of a user, the shield member comprising a planar piece of flexible material that is adapted to reduce injury to the user's clothes as a result of positioning a bundle of reinforcing bars on the user's thigh and sliding a selected one of the bundle of reinforcing bars along at least a portion of the shield member so as to fall to the ground;

a reinforcing member attached to the shield member at a first location selected so as be adjacent the interface between the thigh and the groin of the user, wherein the reinforcing member comprises a curved rigid member that is attached to a side of the shield member that is positioned adjacent the thigh of the user so that the weight of the bundle of rods, when balanced on the user's thigh, is distributed by the reinforcing member so as to reduce the likelihood of injury occurring as a result of balancing the bundle of reinforcing rods on the user's thigh wherein the reinforcing member is comprised of a curved piece of polycarbonate plastic that is approximately 2 inches wide, 10¼" inches long and is curved so that the ends of the reinforcing member are approximately 6½ inches apart; and an attachment mechanism coupled with the shield member so as to retain the shield member in the desired location on the user's thigh.

* * * * *